United States Patent [19]

Depperman

[11] 4,241,540

[45] Dec. 30, 1980

[54] FOLDING SCREW AND RAIL ASSEMBLY FOR A GARAGE DOOR OPENER

[75] Inventor: Warren B. Depperman, Waterloo, Iowa

[73] Assignee: Chamberlain Manufacturing Corporation, Elmhurst, Ill.

[21] Appl. No.: 58,678

[22] Filed: Jul. 18, 1979

[51] Int. Cl.[3] ..... E05F 11/00

[52] U.S. Cl. ..... 49/199; 206/321; 49/362

[58] Field of Search ..... 49/199, 200, 362, 365; 403/100, 102; 16/163, 166; 198/668; 206/321; 160/194, 195

[56] References Cited

U.S. PATENT DOCUMENTS

| | | | |
|---|---|---|---|
| 1,359,989 | 11/1920 | Hiegel . | |
| 2,394,163 | 2/1946 | Gebert . | |
| 2,637,550 | 5/1953 | Ritter . | |
| 3,148,765 | 9/1964 | Weiss et al. | 198/668 |
| 3,178,210 | 4/1965 | Dickinson . | |
| 3,466,964 | 9/1969 | Wingquist . | |
| 3,774,295 | 11/1973 | Conlee . | |
| 3,858,452 | 1/1975 | Gatland et al. | 49/199 X |
| 4,032,009 | 6/1977 | Taylor | 206/321 |

FOREIGN PATENT DOCUMENTS

| | | | |
|---|---|---|---|
| 1942634 | 3/1971 | Fed. Rep. of Germany | 49/199 |

*Primary Examiner*—Kenneth Downey

*Attorney, Agent, or Firm*—Hill, Van Santen, Steadman, Chiara & Simpson

[57] ABSTRACT

A hinged screw section for a worm drive garage door operator which allows the worm shaft to be assembled at the factory and folded back upon itself so that it can be shipped in a smaller and shorter package. Two different joints have been developed, one of a "I" type in which the connecting link between the two sections of worm shaft is merely a flat metal section with a hole in each end which fits into a slot in the ends of the two worm shaft sections and the assembly is pinned together with two rivets or bolts and the spacing between the two threaded shafts is such that a rack driven carrier will mate with threads of each portion. A second configuration utilizes an "H" joint and the link contains slots and flat tangs are formed on the ends of the two threaded shafts and joined with rivets to the link.

10 Claims, 8 Drawing Figures

16
16a
16b
17
21
22
31a
31b
32a
32b
41
42
43
46
51
53
54
56
57
58
59
74
81
82
83
84
86
87
91
92
93
94
47a
47b

FOLDING SCREW AND RAIL ASSEMBLY FOR A GARAGE DOOR OPENER

BACKGROUND OF THE INVENTION

1. Field of the Invention

This invention relates in general to garage door operators and in particular to an improved worm drive garage door opener.

2. Description of the Prior Art

Worm drive garage operators presently use a one piece worm and rail section. This requires that a very long container be utilized in shipping the garage door opener since the one piece worm and rail section are ten or more feet in length. This makes it very expensive and very difficult for the average customer to transport from the retail outlet to his home for installation, It is very desirable to provide that the T rail unit and the worm fit in a box that can be placed into the average automobile.

SUMMARY OF THE INVENTION

The present invention comprises a hinged screw worm shaft which can be factory assembled and then folded back upon itself. Two joints are used, one being the "I" type wherein the connecting link comprises a flat metal section with a hole in each end and the ends of the two threaded shafts are slotted and holes are formed through the ends of the shafts and the link and rivets are placed through the holes to flexibly join the two threaded shafts together. The slots and holes are accurately machined so that thread alignment will be maintained between the two threaded shafts so that the door carrying trolley will smoothly pass over the joint thus formed.

A second joint design comprises a "H" joint wherein the connecting link resembles the letter "H" and is formed with slots on either end and flat tangs are formed on the ends of the worm shafts. The ends of the worm shaft fit into the "H" joint and connection is made by a pair of rivets or bolts.

The length of the connecting link can be such that the worm shaft can be installed in the rail sections and the complete assembly can be folded for transportation and packaging.

During installation, the customer merely unfolds the assembly and bolts the rail sections spliced together to complete the assembly of the rail sections and the worm shaft.

Since the installation does not require making the splice by the customer between two rail sections, the threads will be aligned to smoothly move the door carrying trolley over the joint.

Other objects, features and advantages of the invention will be readily apparent from the following description of certain preferred embodiments thereof taken in conjunction with the accompanying drawings although variations and modifications may be made without departing from the spirit and scope of the novel concepts of the disclosure and in which:

DESCRIPTION OF THE PREFERRED EMBODIMENTS

Figure 4:
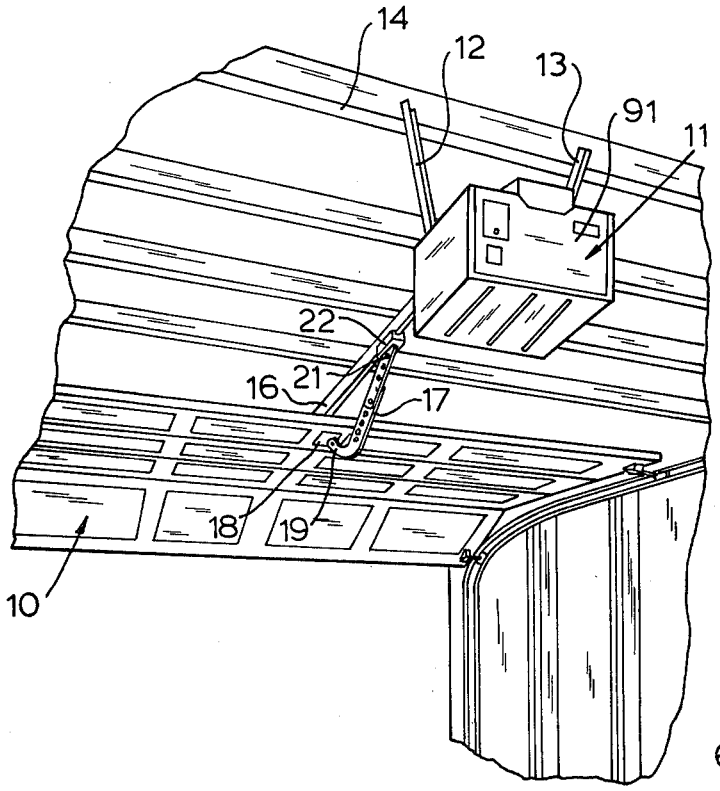
FIG. 4 illustrates the garage door operator installed to move a door.

FIG. 4 illustrates a garage door opener designated generally as 11 mounted on a rafter 14 by hangar members 12 and 13 and connected to a door 10. The rail 16 of the garage door opener carries the worm shaft upon which the trolley 22 rides and a link 17 is pivoted by pivot pin 21 to the trolley at one end and has its other end 19 pivoted to a bracket 18 mounted on the door such that as the trolley is moved by the worm shaft, the door 10 will be moved to the opened or closed positions.

Figures 1, 2, 3:
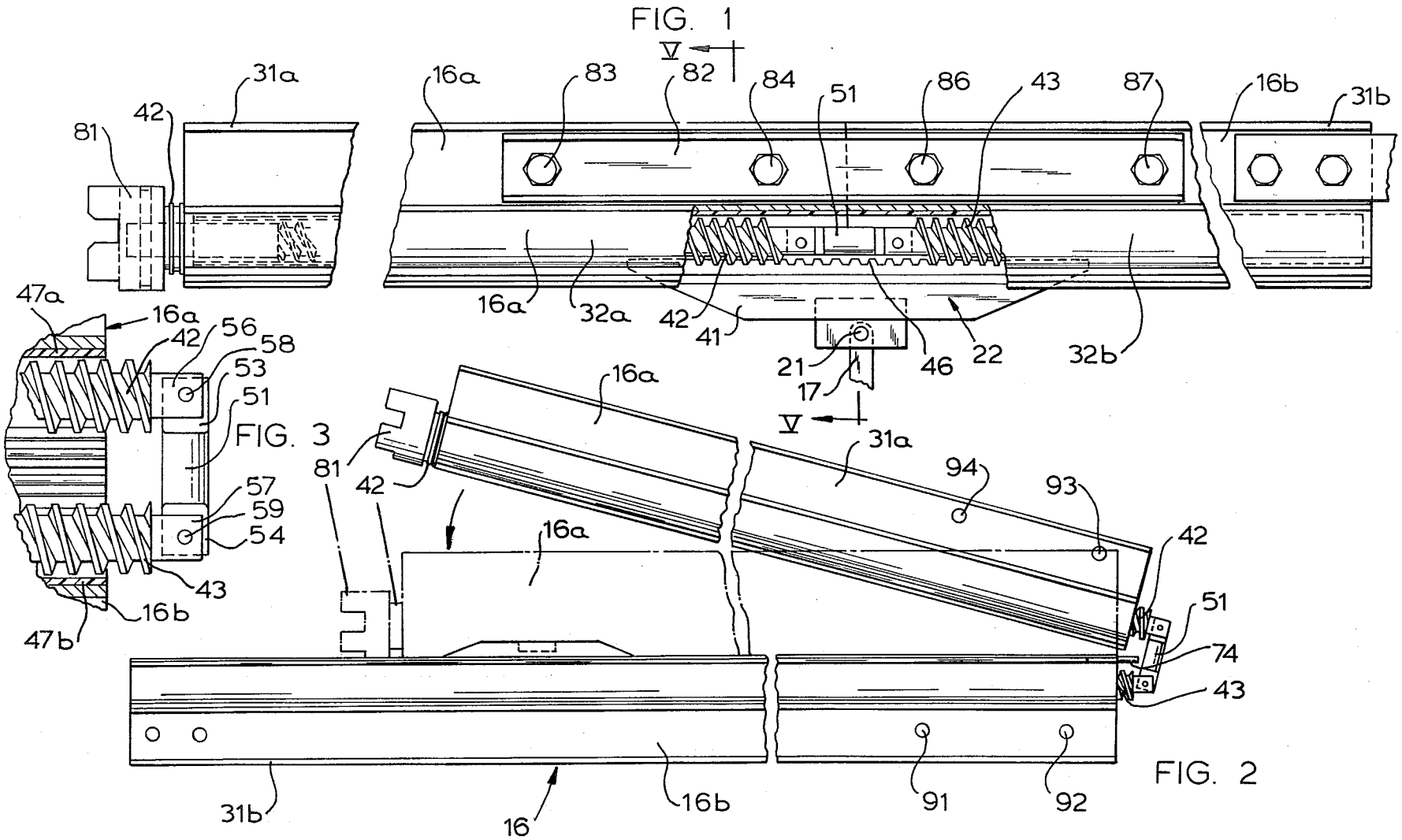
FIG. 1 is a side plan view of the rail, the worm shaft and the door moving trolley with certain portions cut-away.
FIG. 2 illustrates the rail and worm shafts in the folded position.
FIG. 3 is a detail view of the threaded shaft connecting joint.

FIG. 1 is an enlarged partically cut-away view of the rail and worm shaft and trolley. The first T rail portion has a cross-portion 31*a* and downwardly extending portion 16*a* as best shown in sectional view of FIG. 5. A generally cylindrical portion 32 is attached to the lower end of the vertical portion 16*a* and is formed with a second horizontal portion 34 and 36 which are respectively formed with horizontal internal slots 37 and 38. The trolley 22 is formed with a threaded rack plate portion 41 which has teeth which engage the spiral worm of the worm shafts 42 and 43, respectively, and the teeth 46 extend for a substantial longitudinal length along the rail 16 as shown in FIG. 1.

Figure 5:
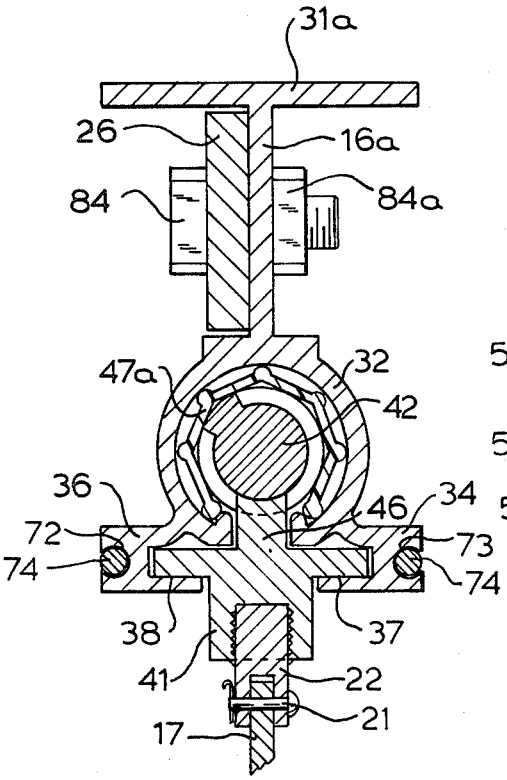
FIG. 5 is a sectional view taken on line V—V in FIG. 1.

As shown in detail in FIG. 5, an inner plastic bearing and guide liner 47 is mounted in the hollow portion 32 of the T rail 16 and the threaded shaft 42 is supported in the plastic liner 47. The portion 32 has an opening through which the teeth 46 of the trolley 22 extend so as to make engagement with the spiral worm of the worm shafts 42 and 43, respectively.

A link 51 is pivotally connected to the ends of the worm shafts 42 and 43 so that the T rail portions 16*a* and 16*b* and the worm shafts 42 and 43 can be pivoted to a stored position as shown in dotted line in FIG. 2 for shipping. The link 51 has flat end portions 53 and 54 which are respectively receivable between U-shaped openings 56 and 57 formed respectively in the ends of shafts 42 and 43. Flat head rivets 58 and 59 make pivotal connections between the ends 53 and 54 of link 51 and portions 56 and 57 of the worm shafts 42 and 43.

Figure 6:
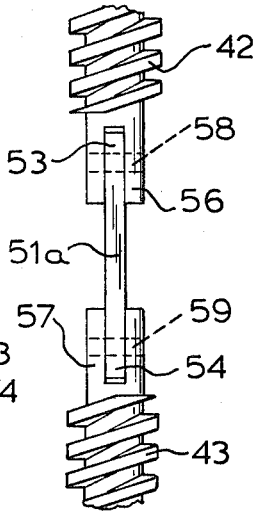
FIG. 6 is a detail view of the I shaped joint.
Figure 7:
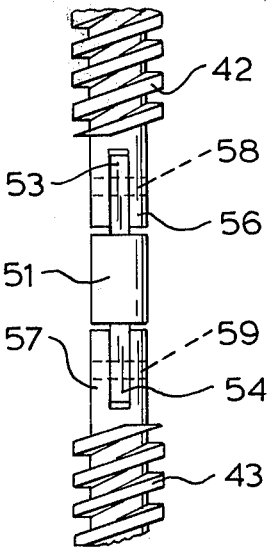
FIG. 7 is a detail view of a modified form of the connecting link.

FIGS. 2, 3 and 7 illustrate links 51 wherein the portion between the extending portions 53 and 54 are generally cylindrical shaped by FIG. 6 illustrates an embodiment of the link 51*a* wherein the link is merely a flat plate.

Figure 8:
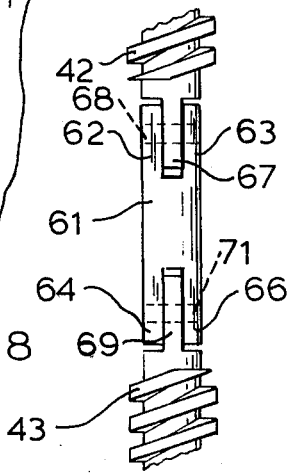
FIG. 8 is a detail view of a modified form of the connecting link.

FIG. 8 illustrates a modification of the link 51 which is formed as an H-shaped portion 61 having a slot formed by extending portions 62 and 63 at one end and 64 and 66 at the other end. The worm shaft 42 is formed with an extending flat portion 67 that is received between the portions 62 and 63 and a rivet 68 pivots the two members together. The shaft 43 is formed with an extending portion 69 and a rivet 71 joins the portions together.

As best shown in FIG. 5, a pair of generally cylindrical shaped grooves 72 and 73 are formed in the portions 36 and 34 respectively and are adapted to receive reinforcing pins 74 which extend from rail portion 16*b* as illustrated in FIG. 2 and are receivable in the openings 72 and 73 so as to make a firm joint between the rail portions 16*a* and 16*b* when in the assembled position illustrated in FIG. 1.

It is to be realized that since the worm shafts 42 and 43 are supported by the plastic bearings members 47 they are free to move longitudinally in the openings 32 of the T rail.

When the T rail assembly is unpacked it is in the form shown in dotted line in FIG. 2. The portion 16*a* is pivoted clockwise relative to FIG. 2 to the position shown in FIG. 1 and the T rail portions 16*a* and 16*b* are joined by using a plate 82 which is attached by bolts and nuts 83, 84, 86 and 87, respectively, to the T rail portions 16*a* and 16*b*. The bolts 83, 84, 86 and 87 pass through openings 91, 92, 93 and 94 in the T rail sections 16*b* and 16*a*, respectively.

The motor not shown is mounted in the housing 91 and connects to a coupling 81 on the end of worm shaft 42 so as to rotate it and through the linkage 51 the worm shafts 43 and thus drive the trolley 22 to move the door up and down.

As the shafts 42 and 43 are rotated by the motor, the teeth 46 of the trolley 22 engage the worm shafts 42 and 43 so that the trolley can move from end to end along the shafts 42 and 43. The linkage 51 and the worms 42 and 43 are positioned relative to each other such that the teeth 46 mate with the worm shafts 42 and 43 as the trolley 22 moves from shaft 42 to 43.

It is seen that this invention provides a new and novel coupling means for worm shaft and T rail for a garage door opener which allows the unit to be compactly packaged for shipping and installation.

Although it has been described with respect to preferred embodiments, it is not to be so limited as changes and modifications may be made therein which are within the full intended scope as defined by the appended claims.

I claim as my invention:

1. A garage door opener comprising, a movable trolley with a worm engaging portion coupled to said door to move it up and down, a pair of worm shafts mounted end to end and said worm engaging portion of said trolley engageable therewith, and means pivotally connecting the adjacent ends of said worm shaft together so that in the unassembled position said worm shaft can be folded along side each other.

2. A garage door opener according to claim 1 including a pair of longitudinal rail portions formed with cylindrical openings in which the pair of worm shafts are respectively mounted, trolley guiding and supporting portions formed in each of said pair of rail portions and slots formed in said pair of rail portions through which said worm engaging portion of said trolley extends to engage said pair of worm shafts.

3. A garage door opener according to claim 2 including a pair of hollow slotted plastic cylindrical members respectively receivable within said cylindrical openings of said pair of longitudinal rail portions and serving as bearings for said pair of worm shafts.

4. A garage door opener according to claim 2 including a locking plate attachable to said pair of longitudinal rail portions to lock them in end to end position.

5. A garage door opener according to claim 4 wherein at least one guide hole is formed in the end of one of said pair of longitudinal rail portions and at least one mating locking pin extending from the end of the other of said pair of longitudinal rail portions and receivable in said guide hole formed in said one longitudinal rail portion.

6. A garage door opener according to claim 4 wherein said means pivotally connecting the adjacent ends of said worm shafts together comprises a link with openings formed adjacent opposite ends, a first U-shaped portion formed in the end of one of said worm shafts and one end of said link receivable therebetween, and a first pivot pin extending through the opening formed in one end of said link and through mating openings formed through said first U-shaped portion, a second U-shaped portion formed in the end of the other of said worm shafts and the other end of said link receivable therebetween, and a second pivot pin extending through the opening formed in the other end of said link and through mating openings formed through said second U-shaped portion.

7. A garage door opener according to claim 6 wherein said link is a flat plate.

8. A garage door opener according to claim 6 wherein in the central portion of said link is cylindrical shaped.

9. A garage door opener according to claim 4 wherein said means pivotally connecting said worm shaft together comprises a link with a pair of U-shaped portions formed on opposite ends thereof, a first flattened portion formed on the end of one of said worm shafts and receivable between one of said pair of U-shaped portions and a first pivot pin extending through aligned openings through said first flattened portion and said one U-shaped portion and a second flattened portion formed on the end of the other of said worm shafts and receivable between the other of said pair of U-shaped portions and a second pivot pin extending through aligned openings formed through said second flattened portion and said other of said pair of U-shaped portions.

10. A garage door opener according to claim 1 wherein said worm engaging portion extends across the space between said pair of worm shafts to engage both worms.

* * * * *